US008459571B2

(12) United States Patent
Graupner et al.

(10) Patent No.: US 8,459,571 B2
(45) Date of Patent: Jun. 11, 2013

(54) METHOD AND DEVICE FOR OPERATING AN INJECTION VALVE, COMPUTER PROGRAM AND INJECTION VALVE

(75) Inventors: Olaf Graupner, Köfering (DE); Klaus Wenzlawski, Nürnberg (DE)

(73) Assignee: Continental Automotive GmbH, Hannover (DE)

( * ) Notice: Subject to any disclaimer, the term of this patent is extended or adjusted under 35 U.S.C. 154(b) by 675 days.

(21) Appl. No.: 12/663,852

(22) PCT Filed: Jun. 2, 2008

(86) PCT No.: PCT/EP2008/056744

§ 371 (c)(1),
(2), (4) Date: May 6, 2010

(87) PCT Pub. No.: WO2008/151958

PCT Pub. Date: Dec. 18, 2008

(65) Prior Publication Data

US 2010/0213270 A1 Aug. 26, 2010

(30) Foreign Application Priority Data

Jun. 12, 2007 (DE) ..... 10 2007 026 946

(51) Int. Cl.
*F02D 1/06* (2006.01)

(52) U.S. Cl.
USPC ..... 239/5; 239/4; 239/102.2; 239/533.4; 239/585.1; 239/585.5; 123/472; 123/498

(58) Field of Classification Search
CPC .... B05B 1/08; B05B 1/30; B05B 17/04; F02D 1/06; F02M 45/00; F02M 51/00
USPC ..... 239/4, 5, 102.1, 102.2, 533.4, 584, 239/585.1–585.5; 123/472, 479, 480, 497, 123/498
See application file for complete search history.

(56) References Cited

U.S. PATENT DOCUMENTS 5,025,766 A 6/1991 Yamauchi et al. ..... 123/472
5,099,815 A 3/1992 Yamauchi et al. ..... 123/472

(Continued)

FOREIGN PATENT DOCUMENTS

DE 2926217 1/1981
DE 3828591 3/1989

(Continued)

OTHER PUBLICATIONS

German Office Action for Application No. 10 2007 026 946.5 (3 pages), Nov. 20, 2007.

(Continued)

*Primary Examiner* — Steven J Ganey
(74) *Attorney, Agent, or Firm* — King & Spalding L.L.P.

(57) ABSTRACT

An injection valve has a valve body and a valve pin. The valve body has a metering orifice. In a closed position of the valve pin, the flow of fluid through the metering orifice is disabled and otherwise released. A control signal (ANS_SIG) for metering fluid with the injection valve is generated for a first valve pin actuator which is coupled to the valve pin to drive the valve pin. At least one first atomization signal (ZER_SIG_1) for the first and/or the second valve pin actuator is generated at least during a predetermined interval during the control of the first valve pin actuator with the control signal (AN_SIG) in such a manner that the valve pin is oscillatingly displaced relative to a position of the valve pin in response to the first atomization signal (ZER_SIG_1), the valve pin having said position in response to the control signal (ANS_SIG).

20 Claims, 4 Drawing Sheets

U.S. PATENT DOCUMENTS

| | | | | |
|---|---|---|---|---|
| 6,811,093 | B2 * | 11/2004 | Rado | 239/102.2 |
| 7,640,918 | B2 * | 1/2010 | Perryman et al. | 123/479 |
| 2006/0202053 | A1 * | 9/2006 | Gibson et al. | 239/585.1 |
| 2007/0092426 | A1 * | 4/2007 | Driscoll et al. | 423/352 |
| 2008/0202102 | A1 | 8/2008 | Rodriguez-Amaya et al. | 60/286 |

FOREIGN PATENT DOCUMENTS

| | | |
|---|---|---|
| DE | 10011711 | 10/2001 |
| DE | 102004037719 | 3/2006 |
| DE | 102005034704 | 2/2007 |
| EP | 1277941 | 1/2003 |
| EP | 1724003 | 11/2006 |

OTHER PUBLICATIONS

International Search Report and Written Opinion for Application No. PCT/EP2008/056744 (15 pages), Jan. 20, 2009.

* cited by examiner

METHOD AND DEVICE FOR OPERATING AN INJECTION VALVE, COMPUTER PROGRAM AND INJECTION VALVE

CROSS-REFERENCE TO RELATED APPLICATIONS

This application is a U.S. National Stage Application of International Application No. PCT/EP2008/056744 filed Jun. 2, 2008, which designates the United States of America, and claims priority to German Application No. 10 2007 026 946.5 filed Jun. 12, 2007, the contents of which are hereby incorporated by reference in their entirety.

TECHNICAL FIELD

The invention relates to a method and a device for operating an injection valve. The injection valve comprises a valve body with a metering orifice. The injection valve further comprises a valve pin, through which, in a closed valve pin position, the flow of fluid through the orifice is disabled and is otherwise released. To meter fluid a control signal is generated for a first valve pin actuator which is coupled to the valve pin for driving the valve pin. The invention further relates to a computer program designed for carrying out the method on a computer. The invention further relates to an injection valve.

BACKGROUND

As a result of efforts to reduce pollutant emissions from internal combustion engines, measures have been taken through which an internal combustion engine has low pollutant emissions at high efficiency. The high efficiency with low pollutant emissions can for example be achieved by a metering of fuel for a combustion process in the internal combustion engine being designed in an especially advantageous manner. For example by metering the fuel under high pressure, at pressures of up to 200 bar for diesel engines for example, a combustion process can run more effectively in the internal combustion engine, so that the high efficiency with low pollutant emissions is achieved.

The pollutant emissions can also be reduced by exhaust gas aftertreatment. For example, to reduce nitric oxide emissions, urea can be metered into the exhaust of the internal combustion engine. A quality of exhaust gas aftertreatment by means of the urea depends on a quality of the metering of the urea.

SUMMARY

According to various embodiments, a method, a device and a computer program for operating an injection valve and an injection valve for metering of fluid can be created that contributes to the fluid being able to be metered especially effectively.

According to an embodiment, in a method for operating an injection valve comprising a valve body that has a metering orifice, and that comprises a valve pin through which, in a closed position of the valve pin, a fluid flow through the metering orifice is disabled and otherwise is released, —during metering of fluid a control signal is generated for a first valve pin actuator which is coupled to the valve pin for driving the valve pin, and—at least during a predetermined interval during the control of the first valve pin actuator with the control signal at least one first atomization signal for the first and/or a second valve pin actuator is generated in such a manner that the valve pin is oscillatingly displaced because of the first atomization signal relative to a valve pin position that the valve pin assumes in response to the control signal.

According to a further embodiment, the first atomization signal can be impressed onto the control signal. According to a further embodiment, the second valve pin actuator can be activated by means of a second atomization signal, with the second atomization signal being generated in such a manner that the valve pin is moved in response to the second atomization signal relative to a valve pin position that the valve pin assumes in response to the control signal and/or the first atomization signal. According to a further embodiment, the first and/or second atomization signal may have a single predetermined frequency. According to a further embodiment, the first and/or second atomization signal may have a number of overlaid predetermined frequencies. According to a further embodiment, a characteristic of the first and/or second atomization signal may correspond to a characteristic of a technical noise.

According to another embodiment, a device for operating an injection valve that comprises a valve body that features a metering orifice, and that comprises a valve pin through which, in a closed position of the valve pin, a fluid flow through the metering orifice is disabled and otherwise released, may be embodied, —for metering of fluid, to generate a control signal for a first valve pin actuator that is coupled to the valve pin for driving the valve pin, —at least during a predetermined interval during the control of the first valve pin actuator by the control signal, to generate at least one first atomization signal for the first and/or a second valve pin actuator in such a manner that the valve pin is moved in response to the first atomization signal relative to a valve pin position that the valve pin assumes in response to the control signal.

According to yet another embodiment, a computer program may comprise program instructions that, when executed on a computer, carry out the steps of the above mentioned method.

According to a further embodiment, the computer program can be embodied on a computer-readable medium.

According to another embodiment, an injection valve for metering of fluid may comprise—a valve body with a metering orifice, —a valve pin through which in valve pin closed position a fluid flow through the metering orifice is disabled and otherwise is released, —a first valve pin actuator that is coupled to the valve pin for driving the valve pin, —a second valve pin actuator that is coupled to the valve pin for driving the valve pin and for atomizing the fluid.

According to a further embodiment, the first and/or the second valve pin actuator may comprise a solid state actuator.

BRIEF DESCRIPTION OF THE DRAWINGS

Exemplary embodiments o are explained in greater detail below with reference to schematic diagrams.

The figures show.

Elements of the same construction or function are identified in all figures by the same reference symbols.

DETAILED DESCRIPTION

Figure 1:
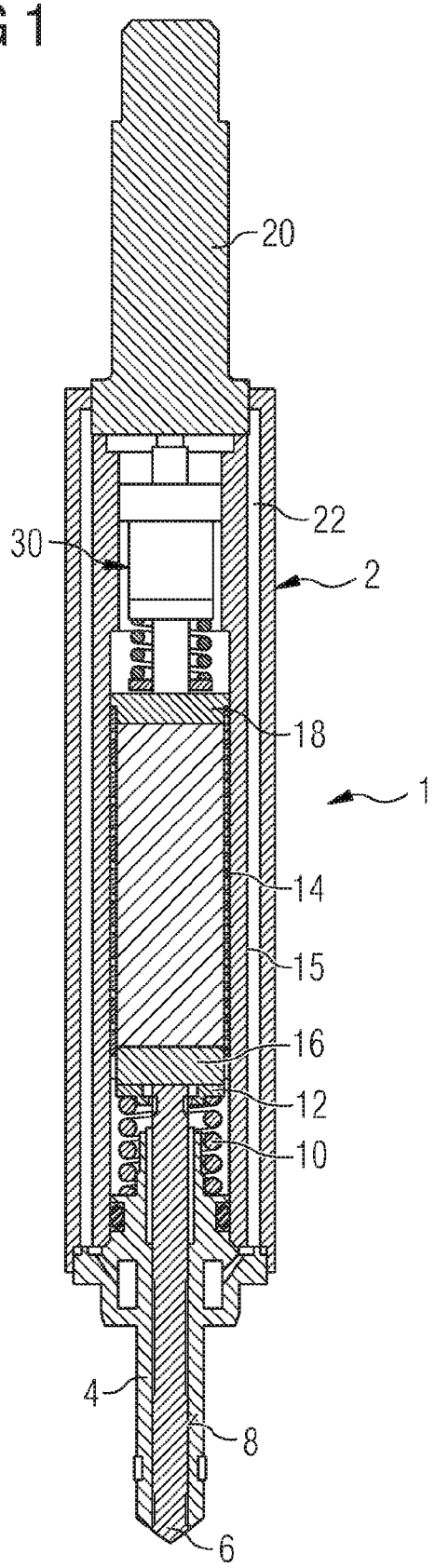
FIG. 1 a first injection valve.

According to a first aspect, in a method and a device for operating an injection valve, the injection valve comprises a valve body having a metering orifice. The injection valve further comprises a valve pin through which, in a closed valve pin position, a fluid flow through the metering orifice is disabled and otherwise is released. To meter fluid a control signal is generated for a first valve pin actuator. To drive the valve pin, the first valve pin actuator is coupled to the valve pin. At least during a predetermined period of time during the control of the first valve pin actuator with the control signal, at least one first atomization signal is generated for the first and/or a second valve pin actuator in such a manner that the valve pin, as a result of the first atomization signal, is oscillatingly displaced relative to a valve pin position that the valve pin assumes as a result of the control signal.

The valve pin being oscillatingly displaced as a result of the first atomization signal relative to a valve pin position that the valve pin assumes as a result of the control signal means in this context that a metering movement of the valve pin as a result of the control signal will be overlaid by an atomization movement of the valve pin as a result of the first atomization signal. The atomization movement transfers mechanical energy to the metering fluid, which increases an energy content of the fluid to be metered and thus leads to a smaller average droplet size of the fluid, compared to a metering process without atomization movement. Furthermore the stream of fluid being interrupted again and again by the atomization movement brings about the smaller average droplet size. This leads to the metered fluid being better distributed in a combustion chamber or in an exhaust gas tract of an internal combustion engine. This leads to a better mixture of the fuel with fresh air in the combustion chamber or to a better mixture of the urea with the exhaust gas in the exhaust gas tract. This leads to a more complete combustion or to lower pollutant emissions compared to an injection valve operated without the atomization signal.

According to a further embodiment, the first atomization signal is impressed onto the control signal. This can contribute in a simple manner to the valve pin being displaced as a result of the first atomization signal relative to a valve pin position that the valve pin assumes as a result of the control signal. This also makes it possible to dispense with a second valve pin actuator.

In a further embodiment of the first aspect, the second valve pin actuator is controlled by means of a second atomization signal. The second atomization signal will be created in such a manner that the valve pin is displaced as a result of the second atomization signal relative to a valve pin position that the valve pin assumes as a result of the control signal and/or as a result of the first atomization signal. This can contribute in a simple manner to the valve pin being displaced as a result of one of the atomization signals relative to a valve pin position that the valve pin assumes as result of the control signal. This can also contribute to achieving an even smaller average droplet size, since yet more energy can be introduced into the metering stream.

In a further embodiment of the first aspect, the first and/or the second atomization signal has a single predetermined frequency. This can contribute in a simple manner to achieving the fine atomization of the fluid during metering of the fluid.

In a further embodiment of the first aspect, the first and/or the second atomization signal has a number of overlaid predetermined frequencies. This can contribute to achieving an especially fine atomization of the fluid during metering.

In a further embodiment of the first aspect, a characteristic of the first and/or second atomization signal corresponds to a characteristic of a technical noise. This can contribute to achieving an especially fine atomization of the fluid during metering.

According to a second aspect, a computer program comprises program instructions which, when executed on a computer, carry out the method according to the first aspect.

In an embodiment of the second aspect the computer program is embodied on a computer-readable medium.

According to a third aspect, an injection valve for metering of fluid comprises a valve body with a metering orifice. The injection valve further comprises a valve pin through which, in a closed valve pin position, a fluid flow through the metering orifice is disables and otherwise is released. A first valve pin actuator of the injection valve is coupled to the valve pin for driving the valve pin. A second valve pin actuator of the injection valve is coupled to the valve pin for driving the valve pin and for atomizing the fluid. This can contribute especially effectively to the fluid being especially finely atomized by means of the injection valve.

In an embodiment of the third aspect, the first and/or the second valve pin actuator comprises a solid state actuator. This makes it possible to set an especially high frequency in the atomizer movement. This can contribute to an especially fine atomization of the fluid.

A first injection valve 1 (FIG. 1) comprises a valve body 2 of the first injection valve 1, a valve nozzle body 4 of the first injection valve 1 and a first valve pin actuator 14 of the first injection valve 1. The first injection valve 1 is preferably embodied as a fluid-injection valve for metering of fluid. The fluid can for example be fuel that will be metered for a combustion process to a combustion chamber of an internal combustion engine. As an alternative to this, the fluid can be urea that can be metered with the first injection valve 1 for exhaust gas aftertreatment to an exhaust gas tract of the internal combustion engine. The valve body 2 of the first injection valve 1 is for example embodied in the shape of a double tube.

The nozzle body 4 of the first injection valve 1 has a cutout B. A valve pin 6 of the first injection valve 1 is arranged axially movably in the cutout 8 of the nozzle body 4 of the first injection valve 1. In a closed position 6 of the valve pin of the first injection valve 1, the valve pin 6 of the first injection valve 1, in interaction with the nozzle body 4 of the first injection valve 1 suppresses a fluid flow through a metering orifice of the first injection valve 1. The metering orifice of the first injection valve 1 is formed outside the closed valve pin position 6 of the first injection valve 1 by a cylindrical gap between the valve pin 6 of the first injection valve 1 and the nozzle body 4 of the first injection valve 1, through which the fluid can be metered into the combustion chamber or the exhaust gas tract of the internal combustion engine. A valve pin spring 10 of the first injection valve 1 pre-tensions the valve pin 6 of the first injection valve 1 via a spring support 12 in the direction of the first valve pin actuator 14 of the first injection valve 1, which is preferably embodied as a solid state actuator, especially as a piezoactuator. The effect of this is to close the metering orifice of the first injection valve 1 when the valve pin actuator 14 of the first injection valve 1 is not being activated.

The first valve pin actuator 14 of the first injection valve 1 acts via a base plate 16 on the valve pin 6 of the first injection valve 1. Arranged on the side of the base plate 16 facing away from the first valve pin actuator 14 of the first injection valve 1 is a cover plate 18. The top plate 18 is preferably coupled to a compensation element 30 that rests on the side of the compensation element 30 facing away from the top plate 18 on a fluid connection 20 of the first injection valve 1.

The fluid connection 20 of the first injection valve 1 can comprise a number of feed lines, holes and cutouts that are suitable for example for feeding fluid into the first injection valve 1 or for accepting electrical lines for conducting electrical signals for example to the first valve pin actuator 14 of the first injection valve 1. A fluid line 22 of the first injection valve 1 is for example formed by the space between an outer tube and an inner tube 15 of the twin-tube-shaped valve body 2. The fluid can alternately also be routed via a cutout in the valve body 2 of the first injection valve 1 to the metering orifice of the first injection valve 1.

The valve pin position 6 of the first injection valve 1 is determined by the forces that the valve pin spring 10 and the first valve pin actuator 14 of the first injection valve 1 exert on the valve pin 6 of the first injection valve 1. Provided the force that the first valve pin actuator 14 of the first injection valve 1 exerts on the valve pin 6 of the first injection valve 1 is less than the force that the valve pin spring 10 exerts on the valve pin 6 of the first injection valve 1, the metering orifice of the first injection valve 1 is closed and metering of fluid is disabled. As soon as the force that the first valve pin actuator 14 of the first injection valve 1 exerts on the valve pin 6 of the first injection valve 1 is greater than the force that the valve pin spring 10 of the first injection valve 1 exerts on the valve pin 6 of the first injection valve 1, the valve pin 6 of the first injection valve 1 will be pushed in a direction away from the first valve pin actuator 14 of the first injection valve 1 and will thus release the metering orifice of the first injection valve 1. A further force on the valve pin 6 of the first injection valve 1 can be exerted by the fluid on the valve pin 6 of the first injection valve 1.

An extension of the piezoactuator is regulated by the voltage applied to it. In such cases the electrical energy deposited in the piezoactuator, especially the deposited electrical charges, is representative of the expansion of the piezoactuator. In addition the expansion of the piezoactuator will be determined by its temperature. The greater is the temperature of the piezoactuator the greater is its extension. Since the expansion of the piezoactuator because of temperature fluctuations lies in the order of magnitude of the expansion as a result of the deposited electric charges, it must be ensured that the corresponding injection valve also functions precisely over a very wide range of temperatures. For this purpose the piezoactuator is arranged axially movably in the valve body 2 of the first injection valve 1 and is coupled to the compensation element 30 to compensate for the thermal expansion.

Figure 2:
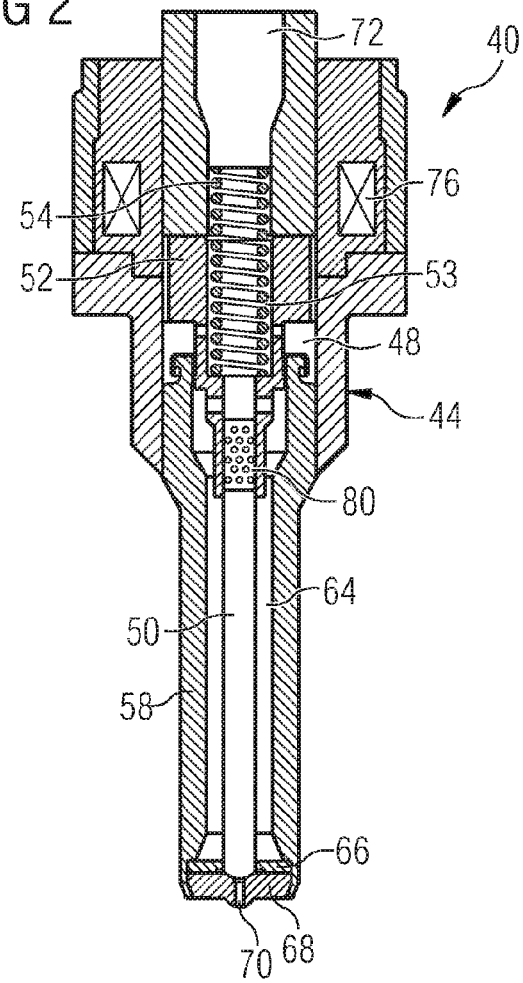
FIG. 2 a second injection valve.

A second injection valve 40 comprises a valve body 44 of the second injection valve 40 (FIG. 2). The valve body 44 of the second injection valve 40 has a cutout 48. Arranged axially movably in the cutout 48 of the valve body 44 of the second injection valve 40 is a valve pin 50 of the second injection valve 40. The valve pin 50 of the second injection valve 40 is coupled permanently to an armature 52. The armature 52 has a cutout 53, in which a valve pin spring 54 of the second injection valve 40 is at least partly arranged. Furthermore a nozzle body 58 of the second injection valve 40 is partly arranged in the cutout 48 of the valve body 44 of the second injection valve 40. The nozzle body 58 of the second injection valve 40 has a cutout 64. The cutout 64 of the nozzle body 58 of the second injection valve 40 is delimited on a side of the nozzle body 58 of the second injection valve 40 facing away from the valve pin spring 54 of the second injection valve 40 by a lower valve pin guide 66 and a valve pin seat 68. The valve pin seat 68 comprises at least one metering orifice 70 of the second injection valve 40.

In a closed position 50 of the valve pin of the second injection valve 40 the valve pin 50 of the second injection valve 40, in conjunction with the valve pin seat 68, disables a fluid flow through the metering orifice 70 of the second injection valve 40 and otherwise releases the latter. The second injection valve 40, like the first injection valve, is suitable for metering fluid, especially fuel and/or urea. The fluid can be supplied to the second injection valve 40 via a fluid connection 72 of the second injection valve 40.

A first valve pin actuator of the second injection valve 40 comprises for example a magnetic coil 76 and the armature 52. If a suitable current is flowing through the magnetic coil 76 a magnetic field is created that exerts a force on the armature 52 that acts in a direction away from the metering orifice 70 of the second injection valve 40. As a result of the movement of the armature 52 the valve pin 50 of the second injection valve 40 moves out of its closing position provided the force acting as a result of the magnetic field via the armature 52 on the valve pin 50 of the second injection valve 40 is greater than the force that the valve pin spring 53 of the second injection valve 40 exerts on the valve pin 50 of the second injection valve 40. With the second injection valve 40 too a force can be exerted on the valve pin 50 of the second injection valve 40 by the metering fluid.

In addition to the first valve pin actuator of the second injection valve 40 a second valve pin actuator 80 can be provided in the second injection valve 40. The second valve pin actuator 80 preferably couples an upper section of the valve pin 50 of the second injection valve 40 to a lower section of the valve pin 50 of the second injection valve 40. As an alternative the second valve pin actuator 80 can couple the lower section of the valve pin 50 of the second injection valve 2 that faces towards the metering orifice 70 of the second injection valve 2 to the armature 52.

Figure 3:
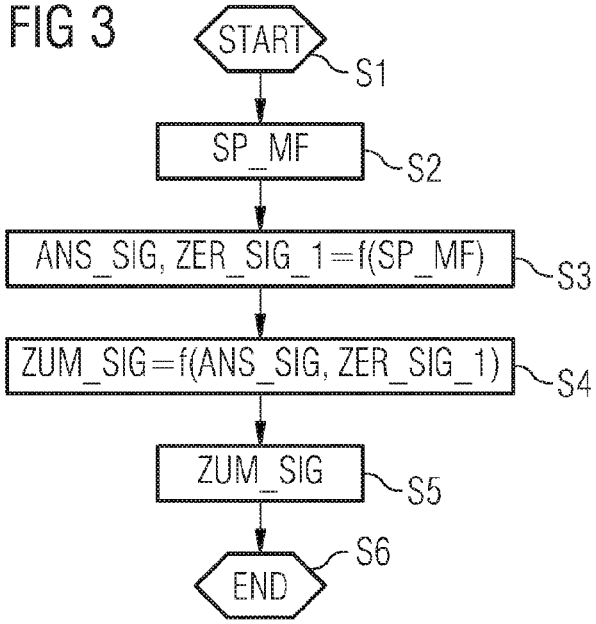
FIG. 3 a flow diagram of a program for operating the injection valves.

A program (FIG. 3) for operating at least one of the two injection valves is preferably stored on a storage medium. The storage medium can for example be included in a control device for a motor vehicle in which for example one of the two injection valves is arranged. The program serves to ensure that the fluid that is metered with the corresponding injection valve is atomized especially well during metering, i.e. has a preferably especially small average droplet size.

The program is preferably started in a step S1 in which variables are initialized if necessary.

In a step S2 a setpoint mass flow value SP_MF of a fluid mass is determined. The setpoint value SP_MF of the fluid mass is determined for example as a function of a torque requirement made on the internal combustion engine or as a function of a nitric oxide content of an exhaust of the internal combustion engine. For example the setpoint value SP_MF of the fluid mass can be stored in an engine map as a function of the torque requirement or the nitric oxide content of the exhaust. The engine map can for example be recorded on an engine test bed and stored on the storage medium. As an alternative, a model calculation can be determined through which the setpoint value SP_MF of the fluid mass is able to be determined.

In a step S3 a control signal ANS_SIG is preferably determined as a function of the setpoint value SP_MF of the fluid mass. The control signal ANS_SIG preferably serves to control the first valve pin actuator 14 of the first injection valve 1 and/or the first valve pin actuator of the second injection valve 40, especially the magnetic coil 76, in such a manner that the corresponding valve pin will be moved out of its closed position and the fluid will be metered.

Additionally, in step S3, a first atomization signal ZER_SIG_1 is determined, for example as a function of the setpoint value SP_MF of the fluid mass. Whether the setpoint value SP_MF of the fluid mass is considered during determination of the first atomization signal ZER_SIG_1 depends for example on an amplitude of the atomization signal ZER_SIG_1. This depends especially on how strongly the actual metered fluid mass is changed by the first atomization signal ZER_SIG_1 compared to the control of the corresponding valve pin actuator without the first atomization signal ZER_SIG_1.

In a step S4 a metering signal ZUM_SIG is determined as a function of the control signal ANS_SIG and the first atomization signal ZER_SIG_1. Preferably the metering signal ZUM_SIG is determined by the control signal ANS_SIG being impressed onto the first atomization signal ZER_SIG_1. As an alternative one of the two first valve pin actuators can be controlled by means of the control signal ANS_SIG and only the second valve pin actuator 80 of the second injection valve 40 by means of the first atomization signal ZER_SIG_1. During the step S4 a second atomization signal can thus be determined, by means of which exclusively the second valve pin actuator 80 will be activated. A movement of the corresponding valve pin then results from the control signal ANS_SIG, the second atomization signal and/or the first atomization signal ZER_SIG_1.

In a step S5 the first valve pin actuator of the corresponding injection valve is controlled with the metering signal ZUM_SIG. As an alternative, in step S5, the first valve pin actuator of the second injection valve 40 can be activated with the control signal ANS_SIG and/or the metering signal ZUM_SIG and the second valve pin actuator 80 can be activated with the first atomization signal ZER_SIG_1. As an alternative the first valve pin actuator of the second injection valve 40 can be activated with the control signal ANS_SIG and/or the metering signal ZUM_SIG and the second valve pin actuator 80 of the second injection valve 40 can be activated with the second atomization signal. The second atomization signal can correspond to first atomization signal.

The program can be ended in a step S6. Preferably however the program will be run at regular intervals during the operation of the internal combustion engine, being run anew at each injection process for example.

Preferably the program is translated into computer-readable program instructions that are stored on a computer-readable medium, for example the storage medium.

Figure 4:
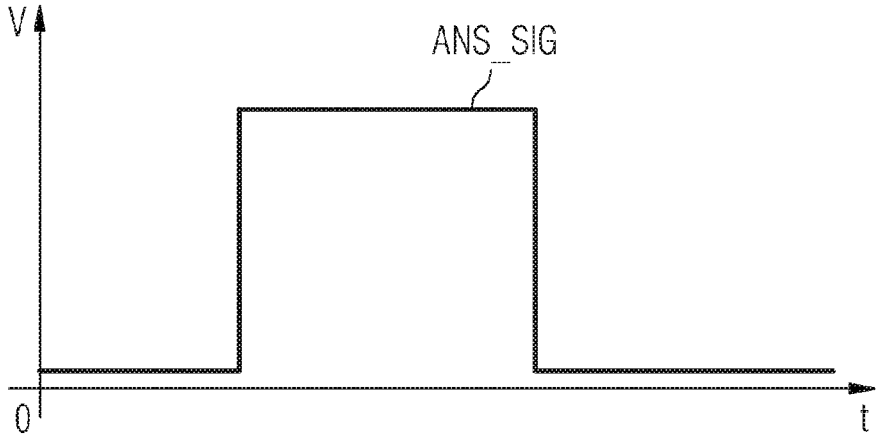
FIG. 4 a control signal.

The control signal ANS_SIG can for example be a square-wave signal (FIG. 4). The control signal ANS_SIG can for example be a voltage V. The metering movement of the corresponding valve pin practically follows the rectangular course of the control signal ANS_SIG, with the edges of a graph of the metering movement being rounded-off in a regular manner and the edges not being entirely perpendicular. As an alternative the control signal ANS_SIG can for example be parabola shaped.

Figure 5:
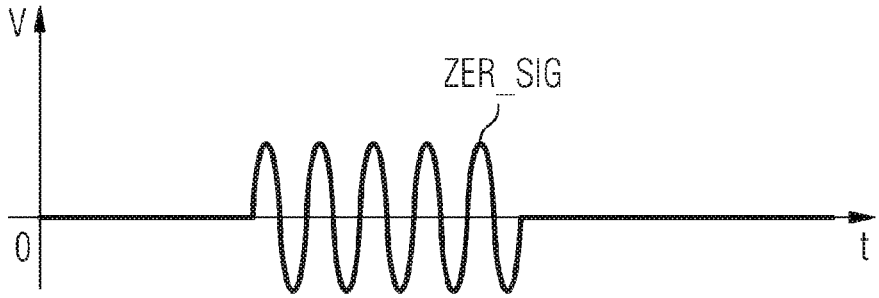
FIG. 5 a first form of embodiment of an atomization signal.
Figure 6:
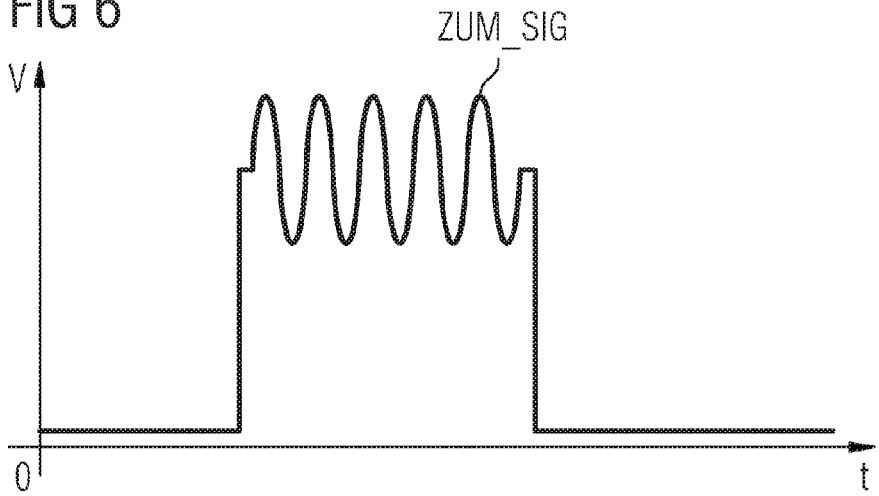
FIG. 6 a metering signal.

The atomization signal ZER_SIG can comprise the first atomization signal ZER_SIG_1 or the second atomization signal and for example have a single frequency and pass through one or more periods (FIG. 5). The metering signal ZUM_SIG, which is created by the impressing of the atomization signal ZER_SIG onto the control signal ANS_SIG, is shown in FIG. 6. Preferably an amplitude of the atomization signal ZER_SIG is smaller than the amplitude of the control signal ANS_SIG. This leads to the movement of the corresponding valve pin because of the control signal ANS_SIG having a greater amplitude than the movement of the corresponding valve pin because of the atomization signal ZER_SIG. As an alternative the two amplitudes can be the same or the amplitude of the atomization signal ZER_SIG can also be greater than the amplitude of the control signal ANS_SIG. This can lead, during the metering process, to the corresponding valve pin closing the corresponding metering orifice at least once during the metering process and disabling the fluid flow through the metering orifice.

Figure 7:
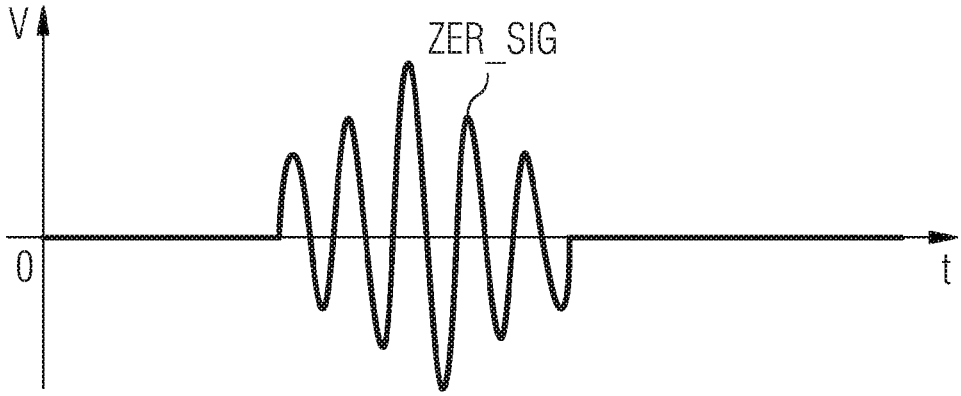
FIG. 7 a second form of embodiment of the atomization signal.

In an alternate form of embodiment (FIG. 7) the atomization signal ZER_SIG can have different amplitudes.

Figure 8:
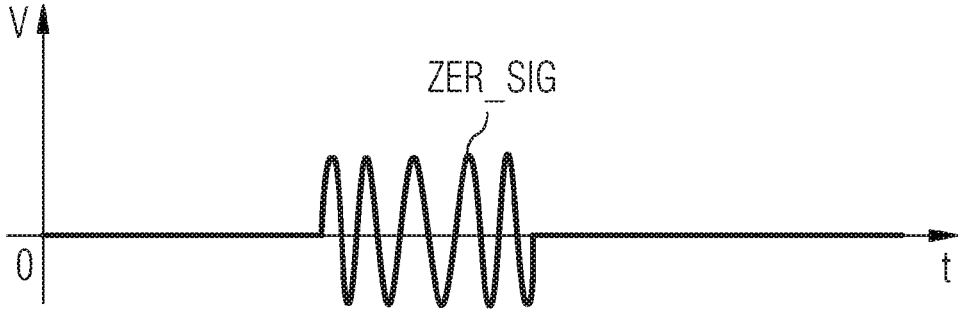
FIG. 8 a third form of embodiment of the atomization signal.

In a further alternate embodiment the atomization signal ZER_SIG can have a number of different frequencies (FIG. 8).

Figure 9:
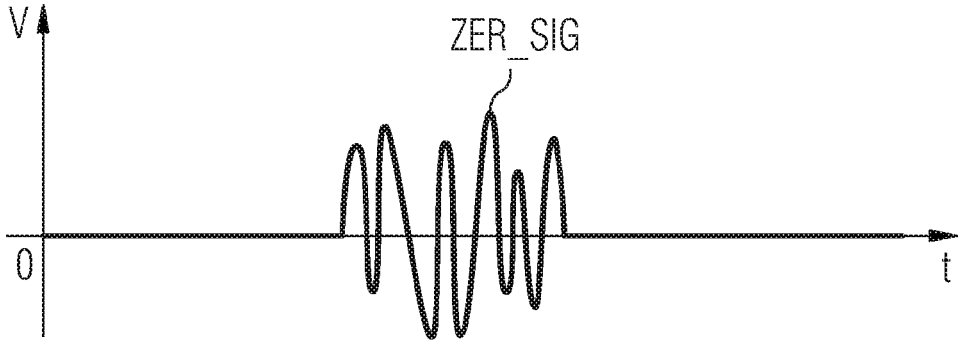
FIG. 9 a fourth form of embodiment of the atomization signal.

In a further alternate embodiment a characteristic of the atomization signal ZER_SIG can correspond to a characteristic of a technical noise (FIG. 9). Technical noise refers to a non-periodic oscillation process, in which over observation periods that are sufficiently large, but otherwise of any given length, the same spectral amplitude distribution for statistically fluctuating null phase angles of the part oscillations is almost always present.

The invention is not restricted to the specified exemplary embodiments. For example the second injection valve 40 can have a solid state actuator, especially a piezoactuator, as its first valve pin actuator. Furthermore there can be a coupling of the valve pin actuators to the corresponding valve pins by means of a hydraulic and/or mechanical transmission. Furthermore an injection valve opening outwards can feature two valve pin actuators and an injection valve opening inwards just one valve pin actuator.

What is claimed is:

1. A method for operating an injection valve comprising a valve body that has a metering orifice and a valve pin through which, in a closed position of the valve pin, a fluid flow through the metering orifice is disabled and otherwise is released, the method comprising the steps of:

for a particular metering of fluid:

generating a control signal configured to provide a displacement of the valve pin, generating a first atomization signal configured to provide an oscillated displacement of the valve pin, applying the control signal to a valve pin actuator system coupled to the valve pin such that the valve pin is displaced to a displaced position, and applying the first atomization signal to the valve pin actuator system such that the valve pin is oscillatingly displaced around the displaced position that the valve pin assumes in response to the control signal, such that the control signal and the first atomization signal cooperate in an additive manner to displace the valve pin.

2. The method according to claim 1, wherein the first atomization signal is impressed onto the control signal.

3. The method according to claim 1, wherein at least one of the first and second atomization signal has a single predetermined frequency.

4. The method according to claim 1, wherein at least one of the first and second atomization signal has a number of overlaid predetermined frequencies.

5. The method according to claim 1, wherein a characteristic of at least one of the first and second atomization signal corresponds to a characteristic of a technical noise.

6. The method according to claim 1, wherein the valve pin actuator system comprises a single valve pin actuator, such that both the control signal and the first atomization signal is applied to the single valve pin.

7. The method according to claim 1, wherein:

the valve pin actuator system comprises a first valve pin actuator and a second valve pin actuator, the control signal is applied to the first valve pin, and the first atomization signal is applied to the second valve pin actuator.

8. The method according to claim 1, wherein:

the valve pin actuator system comprises a first valve pin actuator and a second valve pin actuator, the control signal and the first atomization signal is applied to the first valve pin, and a second atomization signal, different from the first atomization signal, is applied to the second valve pin actuator.

9. A device for operating an injection valve that comprises a valve body that features a metering orifice and a valve pin through which, in a closed position of the valve pin, a fluid flow through the metering orifice is disabled and otherwise released, wherein the device is operable to implement a particular metering of fluid by:

generating a control signal configured to provide a displacement of the valve pin, generating a first atomization signal configured to provide an oscillated displacement of the valve pin, applying the control signal to a valve pin actuator system coupled to the valve pin such that the valve pin is displaced to a displaced position, and applying the first atomization signal to the valve pin actuator system such that the valve pin oscillates in response to the first atomization signal relative to the displaced position that the valve pin assumes in response to the control signal, such that the control signal and the first atomization signal cooperate in an additive manner to displace the valve pin.

10. The device according to claim 9, wherein the valve pin actuator system comprises a single valve pin actuator, such that both the control signal and the first atomization signal is applied to the single valve pin.

11. The device according to claim 9, wherein:

the valve pin actuator system comprises a first valve pin actuator and a second valve pin actuator, the control signal is applied to the first valve pin, and the first atomization signal is applied to the second valve pin actuator.

12. The device according to claim 9, wherein:

the valve pin actuator system comprises a first valve pin actuator and a second valve pin actuator, the control signal and the first atomization signal is applied to the first valve pin, and a second atomization signal, different from the first atomization signal, is applied to the second valve pin actuator.

13. A computer program product for operating an injection valve comprising a non-transitory computer readable medium storing program instructions that, when executed on a computer, carry out the steps of:

for a particular metering of fluid:

generating a control signal configured to provide a displacement of the valve pin, generating a first atomization signal configured to provide an oscillated displacement of the valve pin, applying the control signal to a valve pin actuator system coupled to the valve pin such that the valve pin is displaced to a displaced position, and applying the first atomization signal to the valve pin actuator system such that the valve pin is oscillatingly displaced around the displaced position that the valve pin assumes in response to the control signal, such that the control signal and the first atomization signal cooperate to displace the valve pin in an additive manner.

14. A computer program product according to claim 13, wherein the first atomization signal is impressed onto the control signal.

15. The computer program product according to claim 13, wherein the second valve pin actuator is activated by means of a second atomization signal, with the second atomization signal being generated in such a manner that the valve pin is moved in response to the second atomization signal relative to a valve pin position that the valve pin assumes in response to at least one of the control signal and the first atomization signal.

16. The computer program product according to claim 13, wherein at least one of the first and second atomization signal has a single predetermined frequency.

17. The computer program product according to claim 13, wherein at least one of the first and second atomization signal has a number of overlaid predetermined frequencies.

18. The computer program product according to claim 13, wherein a characteristic of at least one of the first and second atomization signal corresponds to a characteristic of a technical noise.

19. An injection valve for metering of fluid comprising:

a valve body with a metering orifice, a valve pin through which in valve pin closed position a fluid flow through the metering orifice is disabled and otherwise is released, a first valve pin actuator that is coupled to the valve pin for driving the valve pin, a second valve pin actuator that is coupled to the valve pin for driving the valve pin and for atomizing the fluid, wherein the first valve pin actuator and second valve pin actuator are coupled in series such that actuation of the first valve pin actuator displaces the second valve pin actuator along with the valve pin, and a controller configured to:

apply a control signal to the first valve pin actuator to cause a displacement of the valve pin, apply a first atomization signal to at least one of the first and second valve pin actuator to cause an oscillation of the valve pin.

20. The injection valve according to claim 19, wherein at least one of the first and the second valve pin actuator comprises a solid state actuator.

* * * * *